US009217553B2

(12) United States Patent
Medendorp, Jr.

(10) Patent No.: US 9,217,553 B2
(45) Date of Patent: Dec. 22, 2015

(54) LED LIGHTING SYSTEMS INCLUDING LUMINESCENT LAYERS ON REMOTE REFLECTORS

(75) Inventor: Nicholas W. Medendorp, Jr., Raleigh, NC (US)

(73) Assignee: Cree, Inc., Durham, NC (US)

( * ) Notice: Subject to any disclaimer, the term of this patent is extended or adjusted under 35 U.S.C. 154(b) by 336 days.

(21) Appl. No.: 13/216,434

(22) Filed: Aug. 24, 2011

(65) Prior Publication Data

US 2011/0305001 A1 Dec. 15, 2011

Related U.S. Application Data

(63) Continuation of application No. 11/708,818, filed on Feb. 21, 2007, now abandoned.

(51) Int. Cl.
*F21S 8/00* (2006.01)
*F21V 7/00* (2006.01)
(Continued)

(52) U.S. Cl.
CPC ..... *F21V 7/0008* (2013.01); *F21V 7/22* (2013.01); *F21V 9/16* (2013.01); *F21S 8/086* (2013.01); *F21W 2131/103* (2013.01); *F21Y 2101/02* (2013.01)

(58) Field of Classification Search
CPC ..... H01L 33/507; H01L 33/60; H01L 33/504; F21V 7/0008; F21V 14/04; F21V 7/0025; F21V 13/04; F21V 13/08; F21V 17/02; F21V 21/30; F21Y 2101/02; F21K 9/00; F21K 9/56; F21K 9/50; F21S 6/005; F21S 8/088; F21S 8/086
USPC ..... 362/84, 136, 139, 142, 235, 244, 245, 362/249.01, 249.02, 249.1, 276, 2, 82, 283, 362/298, 299, 395, 410, 414, 427, 431
See application file for complete search history.

(56) References Cited

U.S. PATENT DOCUMENTS 4,337,506 A 6/1982 Terada
4,388,678 A 6/1983 Turner
(Continued)

FOREIGN PATENT DOCUMENTS

EP 1 253 373 10/2002
EP 1 566 848 A2 8/2005
(Continued)

OTHER PUBLICATIONS

Machine English Translation of JP 2007-300138, used as an English language eqivalent of WO 2005/055328.*
(Continued)

*Primary Examiner* — Hargobind S Sawhney
(74) *Attorney, Agent, or Firm* — Myers Bigel Sibley & Sajovec, P.A.

(57) ABSTRACT

A lighting system may include a substrate and a light emitting device (LED) on the substrate, and the light emitting device may be configured to transmit light having a first wavelength along a path away from the substrate. A remote reflector may be spaced apart from the light emitting device, and the light emitting device may be between the substrate and the remote reflector. The remote reflector may also be in the path of the light having the first wavelength transmitted by light emitting device. A luminescent layer may be on a surface of the remote reflector, and the luminescent layer may be configured to convert a portion of the light having the first wavelength to light having a second wavelength different than the first wavelength. Moreover, the remote reflector may be configured to reflect light having the first and second wavelengths.

19 Claims, 2 Drawing Sheets

(51) Int. Cl.

| | |
|---|---|
| ***F21V 7/22*** | (2006.01) |
| ***F21V 9/16*** | (2006.01) |
| *F21S 8/08* | (2006.01) |
| *F21W 131/103* | (2006.01) |
| *F21Y 101/02* | (2006.01) |

(56) References Cited

U.S. PATENT DOCUMENTS

| | | | | |
|---|---|---|---|---|
| 4,918,497 | A | 4/1990 | Edmond | |
| 4,933,822 | A | 6/1990 | NakaMats | |
| 4,966,862 | A | 10/1990 | Edmond | |
| 4,994,946 | A | 2/1991 | NakaMats | |
| 5,027,168 | A | 6/1991 | Edmond | |
| 5,134,550 | A | 7/1992 | Young | |
| 5,210,051 | A | 5/1993 | Carter, Jr. | |
| 5,338,944 | A | 8/1994 | Edmond et al. | |
| 5,393,993 | A | 2/1995 | Edmond et al. | |
| 5,416,342 | A | 5/1995 | Edmond et al. | |
| 5,523,589 | A | 6/1996 | Edmond et al. | |
| 5,575,550 | A | 11/1996 | Appeldorn et al. | |
| 5,604,135 | A | 2/1997 | Edmond et al. | |
| 5,631,190 | A | 5/1997 | Negley | |
| 5,739,554 | A | 4/1998 | Edmond et al. | |
| 5,906,425 | A * | 5/1999 | Gordin et al. | 362/153.1 |
| 5,912,477 | A | 6/1999 | Negley | |
| 5,959,316 | A | 9/1999 | Lowery | |
| 6,120,600 | A | 9/2000 | Edmond et al. | |
| 6,187,606 | B1 | 2/2001 | Edmond et al. | |
| 6,201,262 | B1 | 3/2001 | Edmond et al. | |
| 6,234,648 | B1 * | 5/2001 | Borner et al. | 362/235 |
| 6,252,254 | B1 | 6/2001 | Soules et al. | |
| 6,350,041 | B1 | 2/2002 | Tarsa et al. | |
| 6,373,188 | B1 | 4/2002 | Johnson et al. | |
| 6,547,249 | B2 | 4/2003 | Collins, III et al. | |
| 6,573,653 | B1 | 6/2003 | Ishingaga | |
| 6,576,930 | B2 | 6/2003 | Rech et al. | |
| 6,600,175 | B1 | 7/2003 | Baretz et al. | |
| 6,601,984 | B2 | 8/2003 | Yamamoto et al. | |
| 6,635,503 | B2 | 10/2003 | Andrews et al. | |
| 6,642,666 | B1 | 11/2003 | St-Germain | |
| 6,809,347 | B2 | 10/2004 | Tasch et al. | |
| 6,841,804 | B1 | 1/2005 | Chen et al. | |
| 6,885,035 | B2 | 4/2005 | Bhat et al. | |
| 6,936,857 | B2 | 8/2005 | Doxsee et al. | |
| 6,939,481 | B2 | 9/2005 | Srivastava et al. | |
| 6,957,899 | B2 | 10/2005 | Jiang et al. | |
| 7,005,679 | B2 | 2/2006 | Tarsa et al. | |
| 7,009,199 | B2 | 3/2006 | Hall | |
| 7,026,755 | B2 * | 4/2006 | Setlur et al. | 313/501 |
| 7,029,935 | B2 | 4/2006 | Negley et al. | |
| 7,040,774 | B2 | 5/2006 | Beeson et al. | |
| 7,144,131 | B2 | 12/2006 | Rains | |
| 7,213,940 | B1 | 5/2007 | Van De Ven et al. | |
| 7,213,942 | B2 | 5/2007 | Jiang et al. | |
| 7,221,044 | B2 | 5/2007 | Fan et al. | |
| 7,261,441 | B2 | 8/2007 | Ng et al. | |
| 7,358,954 | B2 | 4/2008 | Negley et al. | |
| 7,482,636 | B2 * | 1/2009 | Murayama et al. | 257/98 |
| 7,521,724 | B2 * | 4/2009 | Chen et al. | 257/95 |
| 7,564,180 | B2 | 7/2009 | Brandes | |
| 7,614,759 | B2 | 11/2009 | Negley | |
| 7,703,942 | B2 * | 4/2010 | Narendran et al. | 362/231 |
| 7,703,945 | B2 | 4/2010 | Leung et al. | |
| 7,718,991 | B2 | 5/2010 | Negley | |
| 7,722,220 | B2 | 5/2010 | Van de Ven | |
| 7,791,092 | B2 * | 9/2010 | Tarsa et al. | 257/98 |
| 7,828,460 | B2 | 11/2010 | Van de Ven et al. | |
| 7,852,009 | B2 | 12/2010 | Coleman et al. | |
| 7,852,010 | B2 | 12/2010 | Negley | |
| 7,862,214 | B2 | 1/2011 | Trott et al. | |
| 7,901,111 | B2 | 3/2011 | Negley et al. | |
| 7,959,329 | B2 | 6/2011 | Van de Ven | |
| 8,008,676 | B2 | 8/2011 | Negley et al. | |
| 8,011,818 | B2 | 9/2011 | Negley | |
| 2001/0009510 | A1 | 7/2001 | Lodhie | |
| 2002/0015013 | A1 | 2/2002 | Ragle | |
| 2002/0093820 | A1 | 7/2002 | Pederson | |
| 2002/0123164 | A1 | 9/2002 | Slater, Jr. et al. | |
| 2002/0196638 | A1 | 12/2002 | Stephens et al. | |
| 2003/0001166 | A1 | 1/2003 | Waalib-Singh et al. | |
| 2003/0006418 | A1 | 1/2003 | Emerson et al. | |
| 2003/0042908 | A1 | 3/2003 | St-Germain | |
| 2003/0042914 | A1 | 3/2003 | St-Germain | |
| 2003/0067302 | A1 | 4/2003 | St-Germain | |
| 2003/0089918 | A1 | 5/2003 | Hiller et al. | |
| 2003/0111667 | A1 | 6/2003 | Schubert | |
| 2003/0113108 | A1 | 6/2003 | Bittner | |
| 2003/0128341 | A1 | 7/2003 | Li | |
| 2003/0165061 | A1 | 9/2003 | Martineau | |
| 2003/0201451 | A1 * | 10/2003 | Suehiro et al. | 257/98 |
| 2003/0209997 | A1 | 11/2003 | St-Germain et al. | |
| 2004/0012027 | A1 | 1/2004 | Keller et al. | |
| 2004/0056260 | A1 | 3/2004 | Slater, Jr. et al. | |
| 2004/0095763 | A1 | 5/2004 | Guerrieri et al. | |
| 2004/0184270 | A1 | 9/2004 | Halter | |
| 2004/0217364 | A1 | 11/2004 | Tarsa et al. | |
| 2004/0218391 | A1 | 11/2004 | Procter | |
| 2004/0222735 | A1 | 11/2004 | Ragle | |
| 2004/0223223 | A1 | 11/2004 | Lee | |
| 2004/0252502 | A1 | 12/2004 | McCullough et al. | |
| 2005/0057917 | A1 | 3/2005 | Yatsuda et al. | |
| 2005/0093430 | A1 | 5/2005 | Ibbetson et al. | |
| 2005/0094401 | A1 | 5/2005 | Magarill | |
| 2005/0105301 | A1 | 5/2005 | Takeda et al. | |
| 2005/0128744 | A1 | 6/2005 | You et al. | |
| 2005/0184638 | A1 | 8/2005 | Mueller et al. | |
| 2005/0190559 | A1 | 9/2005 | Kragl | |
| 2005/0248958 | A1 | 11/2005 | Li | |
| 2005/0253151 | A1 | 11/2005 | Sakai et al. | |
| 2005/0270775 | A1 * | 12/2005 | Harbers et al. | 362/231 |
| 2006/0006402 | A1 | 1/2006 | Hsich et al. | |
| 2006/0056169 | A1 | 3/2006 | Lodhie et al. | |
| 2006/0061988 | A1 | 3/2006 | Johnson et al. | |
| 2006/0092643 | A1 | 5/2006 | Wong et al. | |
| 2006/0104060 | A1 | 5/2006 | Kragl | |
| 2006/0105482 | A1 | 5/2006 | Alferink et al. | |
| 2006/0113548 | A1 | 6/2006 | Chen et al. | |
| 2006/0145172 | A1 | 7/2006 | Su et al. | |
| 2006/0181879 | A1 | 8/2006 | Pederson | |
| 2006/0209558 | A1 | 9/2006 | Chinniah et al. | |
| 2007/0024191 | A1 | 2/2007 | Chen et al. | |
| 2007/0051966 | A1 | 3/2007 | Higashi et al. | |
| 2007/0139923 | A1 | 6/2007 | Negley et al. | |
| 2007/0170447 | A1 | 7/2007 | Negley et al. | |
| 2007/0202623 | A1 | 8/2007 | Gao et al. | |
| 2007/0223219 | A1 | 9/2007 | Medendorp et al. | |
| 2007/0274080 | A1 | 11/2007 | Negley et al. | |
| 2007/0279903 | A1 | 12/2007 | Negley et al. | |
| 2007/0297179 | A1 | 12/2007 | Leung et al. | |
| 2008/0030993 | A1 | 2/2008 | Narendran et al. | |
| 2008/0054281 | A1 | 3/2008 | Narendran et al. | |
| 2008/0084685 | A1 | 4/2008 | Van de Ven et al. | |
| 2008/0084701 | A1 | 4/2008 | Van de Ven et al. | |
| 2008/0088248 | A1 | 4/2008 | Myers | |
| 2008/0089053 | A1 | 4/2008 | Negley | |
| 2008/0094829 | A1 | 4/2008 | Narendran et al. | |
| 2008/0105887 | A1 | 5/2008 | Narendran et al. | |
| 2008/0106895 | A1 | 5/2008 | Van de Ven et al. | |
| 2008/0112168 | A1 | 5/2008 | Pickard et al. | |
| 2008/0112170 | A1 | 5/2008 | Trott et al. | |
| 2008/0117500 | A1 | 5/2008 | Narendran et al. | |
| 2008/0130285 | A1 | 6/2008 | Negley et al. | |
| 2008/0179602 | A1 | 7/2008 | Negley et al. | |
| 2008/0198572 | A1 | 8/2008 | Medendorp | |
| 2008/0211416 | A1 | 9/2008 | Negley et al. | |
| 2008/0259589 | A1 | 10/2008 | Van de Ven | |
| 2009/0246895 | A1 | 10/2009 | You et al. | |

FOREIGN PATENT DOCUMENTS

| | | | |
|---|---|---|---|
| EP | 1 571 715 | A1 | 9/2005 |
| EP | 1 760 795 | A2 | 3/2007 |
| JP | 2001-156331 | A | 6/2001 |
| JP | 2001-307506 | A | 11/2001 |

(56) References Cited

FOREIGN PATENT DOCUMENTS

| | | | | |
|---|---|---|---|---|
| JP | 2002133938 | | | 5/2002 |
| JP | 2007300138 | A | * | 11/2007 |
| WO | WO 2005/055328 | | | 6/2005 |
| WO | WO 2005055328 | A1 | * | 6/2005 |
| WO | WO 2006/039017 | | | 4/2006 |
| WO | WO 2006/061728 | A2 | | 6/2006 |
| WO | WO 2007/002234 | A1 | | 1/2007 |

OTHER PUBLICATIONS

U.S. Appl. No. 61/075,513, filed Jun. 25, 2008, Roberts.
U.S. Appl. No. 61/047,824, filed Apr. 25, 2008, Le Toquin.
"High Efficiency, Nitride-Based, Solid-State Lighting", Summary of UCSB Research, Summary of LRC Research, pp. 1-2; http://www.lrc.rpi.edu/programs/solidstate/cr_nitridebasedssl.asp Last Download: Sep. 24, 2011.
International Search Report and Second Written Opinion (11 pages) corresponding to International Application No. PCT/US07/01382; Mailing Date: Feb. 20, 2008.
International Search Report and Written Opinion (10 pages) corresponding to International Application No. PCT/US07/01382; Mailing Date: Dec. 12, 2007.
International Search Report and Written Opinion (13 pages) corresponding to International Application No. PCT/US06/48875; Mailing Date: Feb. 19, 2008.
International Search Report and Written Opinion (15 pages) corresponding to International Application No. PCT/US2008/051633; Mailing date: Aug. 14, 2008.
LEDs Magazine, "Remote Phosphor Technique Improves White LED Output", one page (Apr. 14, 2005); http://www.ledsmagazine.com/news/2/4/22, Last Download: Sep. 24, 2011.
LRC Solid-State Lighting Papers and Publications, Rensselaer Polytechnic Institute, 5 pages. http://www.lrc.rpi.edu/programs/solidstate/SSLLRCAuthored.asp.
Narendran et al., "Extracting phosphor-scattered photons to improve white LED efficiency", Wiley InterScience, Journals: Rapid Research Letter, Physica Status Solidi(a) Abstract, 2 pages (Mar. 17, 2005); http://www3.interscience.wiley.com/journal/110437401/abstract, Last Download: Sep. 24, 2011.
Narendran et al., "Improving the performance of mixed-color white LED systems by using scattered photon extraction technique", International Society for Optical Engineering, Seventh International Conference on Solid State Lighting, Proceedings of SPIE 6669: 666905 (2007).
Narendran, "Improved Performance White LED, Nov. 2005", Society of Photo-Optical Instrumentation Engineers, Fifth International Conference on Solid State Lighting, Proceedings of SPIE 5941, pp. 1-7 (2005).
Zhu et al., "Optimizing the Performance of Remote Phosphor LED", First International Conference on White LED's and Solid State Lighting (White LEDs-07) Tokyo, Japan, 5 pages, (Nov. 26-30, 2007).
"An Even Brighter Idea" Economist.com http://www.economist.com/science/tq/PrinterFriendly.cfm?story_id_=_7904236 ; Sep. 22, 2006 (Science Technology Quarterly) pp. 1-6.
International Search Report and Written Opinion for PCT/US2008/002234; Mailing Date: Jul. 23, 2008.

* cited by examiner

LED LIGHTING SYSTEMS INCLUDING LUMINESCENT LAYERS ON REMOTE REFLECTORS

RELATED APPLICATION

This application claims the benefit of priority as a continuation of U.S. application Ser. No. 11/708,818 filed Feb. 21, 2007 now abandoned, the disclosure of which is hereby incorporated herein in its entirety by reference.

FIELD OF THE INVENTION

The present invention relates to the field of lighting, and more particularly, to LED lighting systems, reflectors, and methods.

BACKGROUND

An incandescent bulb, including a wire filament encased in glass, may emit only about 5% of the energy it consumes as light, with the remaining 95% percent of the energy being wasted as heat. Fluorescent lights may be approximately 4 times more efficient than incandescent bulbs, but may include toxic materials such as mercury vapor. Light emitting diodes may generate light as efficiently as fluorescent lights without the toxic mercury vapor. Light emitting diodes are thus being developed for lighting applications to replace incandescent bulbs and fluorescent lights as discussed, for example, in the article entitled "An Even Brighter Idea" from The Economist Print Edition, Sep. 21, 2006.

U.S. Patent Publication No. 2006/0056169 entitled "Light Module Using LED Clusters" (the '169 publication), for example, discusses a streetlight wherein the conventional incandescent light bulb is replaced by sets of light-emitting LED clusters. In the '169 publication, light emitting diodes are mounted in a downward direction in a manner to disperse light directly onto the intended area of the road or street surface.

Notwithstanding known uses of light emitting diodes to provide lighting, there continues to exist a need in the art for lighting systems providing improved efficiency, brightness, illumination pattern, and/or light color.

SUMMARY

According to some embodiments of the present invention, a lighting system may include a substrate and a light emitting device (LED) on the substrate, and the light emitting device may be configured to transmit light having a first wavelength along a path away from the substrate. A remote reflector may be spaced apart from the light emitting device such that the light emitting device is between the substrate and the remote reflector and such that the remote reflector is in the path of the light having the first wavelength transmitted by light emitting device. A luminescent layer on a surface of the remote reflector may be configured to convert a portion of the light having the first wavelength to light having a second wavelength different than the first wavelength, and the remote reflector may be configured to reflect light having the first and second wavelengths. For example, the light having the first wavelength of light may be a blue light, and the light having the second wavelength of light may be a yellow light.

In addition, a second light emitting device (LED) may be configured to transmit light having a third wavelength different than the first and second wavelengths along a path away from the substrate, and the remote reflector may be spaced apart from the first and second light emitting devices. Moreover, the remote reflector may be in the path of the light having the third wavelength transmitted by the second light emitting device, and the remote reflector may be configured to reflect light having the first, second, and third wavelengths. For example, the light having the first wavelength of light may be a blue light, the light having the second wavelength of light may be a yellow light, and the light having the third wavelength of light may be a red light.

The remote reflector may include a reflective surface on an opaque support member, and the reflective surface may include a metallic layer such as a layer of silver and/or aluminum. The luminescent layer may include a phosphor material in a translucent and/or transparent binder agent, and the binder agent may include a silicone, an epoxy, and/or a plastic. The phosphor material may include a yttrium-aluminum-garnet (YAG) phosphor material, an oxynitride phosphor material, a nitride phosphor material, and/or a zinc oxide phosphor material.

The remote reflector may have a concave reflector surface configured to focus the reflected light having the first and second wavelengths. Moreover, the light emitting device may be spaced apart from the reflector surface and from the luminescent layer by a distance of at least about 1 cm, and more particularly, by a distance of at least about 10 cm.

In addition, a housing reflector on the substrate may surround the light emitting device, and the housing reflector may be spaced apart from the remote reflector. A second light emitting device may also be provided on the substrate, and the second light emitting device may be configured to transmit light having the first wavelength along a path away from the substrate and toward the luminescent layer and the remote reflector. In a street light application, for example, the light emitting device may be spaced apart from the reflector surface and from the luminescent layer by a distance of at least about 1 meter, and more particularly, by a distance in the range of about 2 meters to about 3 meters. A spacing of the light emitting device from the reflector surface and/or from the luminescent layer may be a function of, for example, a size of the reflector surface, a curvature of the reflector surface, an area being illuminated, and/or a distance from the reflector to the area being illuminated.

According to other embodiments of the present invention, a lighting system may include a light emitting device (LED) configured to transmit light having a first wavelength along a path. A remote reflector may be spaced apart from the light emitting device in the path of the light having the first wavelength transmitted by light emitting device. A luminescent layer on a surface of the remote reflector may be configured to convert a portion of the light having the first wavelength to light having a second wavelength different than the first wavelength. Moreover, the remote reflector may be configured to reflect light having the first and second wavelengths, and the light emitting device may be spaced apart from the reflector surface and from the luminescent layer by a distance of at least about 1 cm. For example, the light having the first wavelength of light may be a blue light, and the light having the second wavelength of light may be a yellow light.

The light emitting device may be provided on a substrate such that the light emitting device is between the substrate and the remote reflector. In addition, a second light emitting device (LED) may be configured to transmit light having a third wavelength different than the first and second wavelengths. The remote reflector may be spaced apart from the first and second light emitting devices, and the remote reflector may be in a path of the light having the third wavelength transmitted by the second light emitting device. Accordingly, the remote reflector may be configured to reflect light having the first, second, and third wavelengths. For example, the light having the first wavelength of light may be a blue light, the light having the second wavelength of light may be a yellow light, and the light having the third wavelength of light may be a red light.

The remote reflector may include a reflective surface on an opaque support member, and the reflective surface may include a metallic layer such as a layer of silver and/or aluminum. The luminescent layer may include a phosphor material in a translucent and/or transparent binder agent, and the binder agent may include a silicone, an epoxy, and/or a plastic. The phosphor material may include a yttrium-aluminum-garnet (YAG) phosphor material, an oxynitride phosphor material, a nitride phosphor material, and/or a zinc oxide phosphor material.

The remote reflector may have a concave reflector surface configured to focus the reflected light having the first and second wavelengths, and the light emitting device may be spaced apart from the reflector surface and from the luminescent layer by a distance of at least about 10 cm. In addition, a housing reflector may be provided around the light emitting device, and the housing reflector may be spaced apart from the remote reflector. A second light emitting device adjacent the first light emitting device may also be configured to transmit light having the first wavelength along a path toward the luminescent layer and the remote reflector.

According to still other embodiments of the present invention, a lighting system may include a light emitting device (LED) configured to transmit light having a first wavelength along a path and a housing reflector adjacent the light emitting device. A remote reflector may be spaced apart from the light emitting device and from the housing reflector, and the remote reflector may be in the path of the light having the first wavelength transmitted by light emitting device. A luminescent layer may be provided on a surface of the remote reflector between the remote reflector and the housing reflector and between the remote reflector and the light emitting device. The luminescent layer may be configured to convert a portion of the light having the first wavelength to light having a second wavelength different than the first wavelength, and the remote reflector may be configured to reflect light having the first and second wavelengths. For example, the light having the first wavelength of light may be a blue light, and the light having the second wavelength of light may be a yellow light.

In addition, the light emitting device and the housing reflector may be provided on a substrate between the substrate and the luminescent layer. The remote reflector may include a reflective surface on an opaque support member, and the reflective surface include a metallic layer such as a layer of silver and/or aluminum. The luminescent layer may include a phosphor material in a translucent and/or transparent binder agent, and the binder agent may include a silicone, an epoxy, and/or a plastic. The phosphor material may include a yttrium-aluminum-garnet (YAG) phosphor material, an oxynitride phosphor material, a nitride phosphor material, and/or a zinc oxide phosphor material.

The remote reflector may include a concave reflector surface configured to focus the reflected light having the first and second wavelengths. The light emitting device may be spaced apart from the reflector surface and from the luminescent layer by a distance of at least about 1 cm, and more particularly, by a distance of at least about 10 cm. In a street light application, for example, the light emitting device may be spaced apart from the reflector surface and from the luminescent layer by a distance of at least about 1 meter, and more particularly, by a distance in the range of about 2 meters to about 3 meters. A spacing of the light emitting device from the reflector surface and/or from the luminescent layer may be a function of, for example, a size of the reflector surface, a curvature of the reflector surface, an area being illuminated, and/or a distance from the reflector to the area being illuminated.

DETAILED DESCRIPTION

Figure 1:
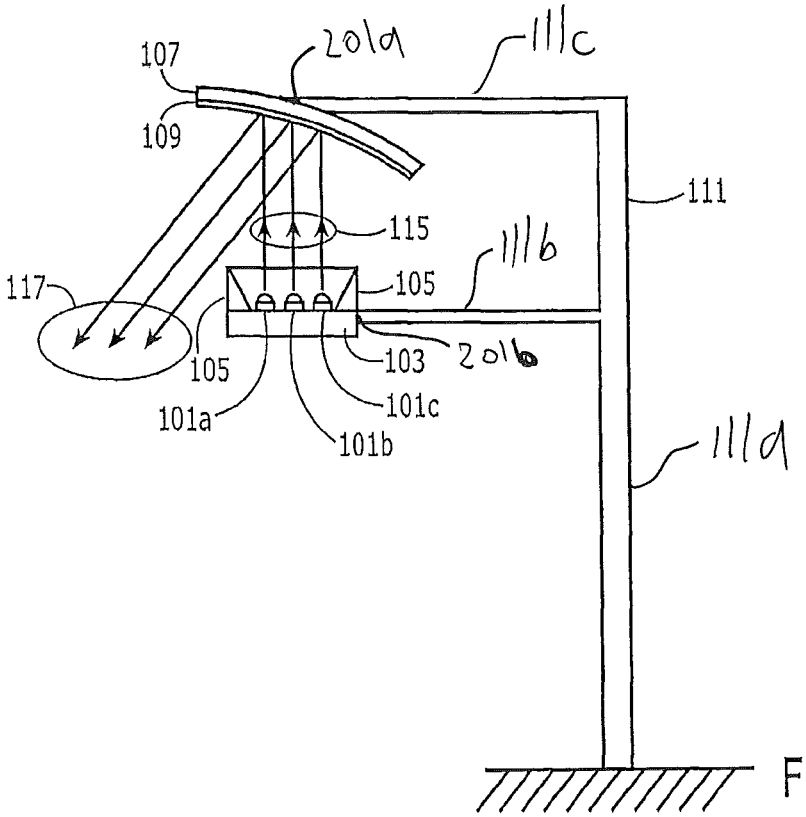
FIG. 1 is a cross-sectional view of lighting systems according to embodiments of the present invention.

Embodiments of the present invention now will be described more hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. Dimensions of layers, elements, and structures may be exaggerated for clarity.

It will be understood that, although the term's first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Various embodiments of the present invention including semiconductor light emitting devices will be described herein. As used herein, the term semiconductor light emitting device (LED) may include a light emitting diode, laser diode and/or other semiconductor device which includes one or more semiconductor layers, which may include silicon, silicon carbide, gallium nitride, indium gallium nitride, and/or other semiconductor materials. A light emitting device may or may not include a substrate such as a sapphire, silicon, silicon carbide and/or another microelectronic substrates. A light emitting device may include one or more contact layers which may include metal and/or other conductive layers. In some embodiments, ultraviolet, blue and/or green light emitting diodes may be provided. Red, red-orange, and/or amber LEDs may also be provided. The design and fabrication of semiconductor light emitting devices are well known to those having skill in the art and need not be described in detail herein.

For example, semiconductor light emitting devices (LEDs) discussed herein may be gallium nitride-based LEDs or lasers fabricated on a silicon carbide substrate such as those devices manufactured and sold by Cree, Inc. of Durham, N.C. The present invention may be suitable for use with LEDs and/or lasers as described in U.S. Pat. Nos. 6,201,262; 6,187,606; 6,120,600; 5,912,477; 5,739,554; 5,631,190; 5,604,135; 5,523,589; 5,416,342; 5,393,993; 5,338,944; 5,210,051; 5,027,168; 4,966,862 and/or U.S. Pat. No. 4,918,497, the disclosures of which are incorporated herein by reference as if set forth fully herein. Other suitable LEDs and/or lasers are described in published U.S. Patent Publication No. US 2003/0006418 A1 entitled Group III Nitride Based Light Emitting Diode Structures With a Quantum Well and Superlattice, Group III Nitride Based Quantum Well Structures and Group III Nitride Based Superlattice Structures, published Jan. 9, 2003, as well as published U.S. Patent Publication No. US 2002/0123164 A1 entitled Light Emitting Diodes Including Modifications for Light Extraction and Manufacturing Methods Therefor, the disclosures of which are hereby incorporated herein in their entirety by reference. Furthermore, phosphor coated LEDs, such as those described in U.S. Patent Publication No. 2004/0056260 A1, entitled Phosphor-Coated Light Emitting Diodes Including Tapered Sidewalls and Fabrication Methods Therefor, the disclosure of which is incorporated by reference herein as if set forth fully, may also be suitable for use in embodiments of the present invention. The LEDs and/or lasers may be configured to operate such that light emission occurs through the substrate. In such embodiments, the substrate may be patterned so as to enhance light output of the devices as is described, for example, in the above-cited U.S. Patent Publication No. US 2002/0123164 A1.

Figure 3:
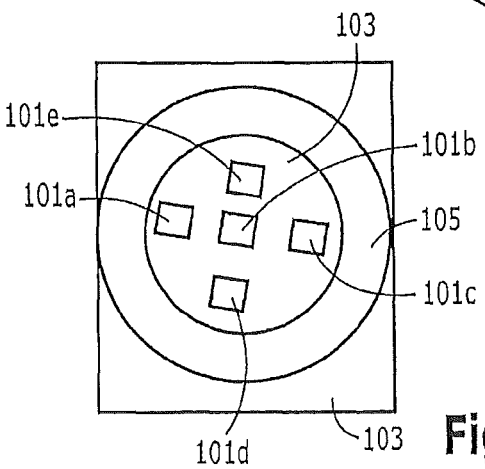
FIG. 3 is an enlarged plan view of a substrate with a housing reflector and light emitting devices thereon according to embodiments of the present invention.

Referring to the embodiments of FIGS. 1 and 3, substrate 103 (also referred to as a submount) may include a printed circuit board (PCB) substrate, an aluminum block substrate, an alumina substrate, an aluminum nitride substrate, a sapphire substrate, and/or a silicon substrate, and/or any other suitable substrate material, such as a T-Clad thermal clad insulated substrate material, available from The Bergquist Company of Chanhassen, Minn. A PCB substrate may include standard FR-4 PCB, a metal-core PCB, flex tape, and/or any other type of printed circuit board.

According to some embodiments of the present invention, a lighting system may include a plurality of light emitting devices (LEDs) 101*a-c* mounted on a substrate 103 and surrounded by a housing reflector 105 on the substrate 103 as shown in FIG. 1. Moreover, each of the light emitting devices (LEDs) 101*a-c* may be configured to transmit light along a respective path(s) 115 away from the substrate. As further shown in FIG. 1, a remote reflector 107 may be spaced apart from the light emitting devices 101*a-c*, and the light emitting devices 101*a-c* may be between the substrate 103 and the remote reflector 107. Moreover, the remote reflector 107 may be in the path(s) 115 of the light transmitted by the light emitting devices 101*a-c*.

At least one of the light emitting devices 101*a-c* may be configured to transmit light having a first wavelength, and a luminescent layer 109 may be provided on a surface of the remote reflector 107. More particularly, the luminescent layer 109 may be configured to convert a portion of the light having the first wavelength to light having a second wavelength different than the first wavelength, and the remote reflector 107 may be configured to reflect light having the first and second wavelengths. For example, the light emitting device 101*a* may be configured to transmit blue light, and the luminescent layer 109 may include a yellow phosphor so that yellow light from the yellow phosphor and blue light from the light emitting device 101*a* reflect off the remote reflector 107 and combine in the target direction 117 to provide white light transmitted in the target direction 117.

The luminescent layer 109 may thus be remote from the light emitting device(s) 101*a-c* so that the luminescent layer 109 and the light emitting device(s) 101*a-c* are separated, for example, by a gap filled with gas, a vacuum gap, and/or a light transmissive material (such as glass). By providing the luminescent layer 109 on the remote reflector 107, separated from the light emitting device(s) 101*a-c* and from the housing reflector 105, an efficiency of transmission/reflection of the light having the second wavelength (i.e., light converted by the luminescent layer 109) in the target direction 117 may be improved.

While a plurality of light emitting devices 101*a-c* are shown in FIG. 1 by way of example, embodiments of the present invention may be provided with only a single light emitting device transmitting light having the first wavelength (such as LED 101*a* transmitting blue light). If a second light emitting device (such as LED 101*b*) is included, the second light emitting device 101*b* may be configured to transmit light having a third wavelength different than the first and second wavelengths along a path away from the substrate 103. With first and second light emitting devices 101*a-b* transmitting different wavelengths of light, the remote reflector 107 is in the path(s) 115 of the light transmitted by the first and second light emitting devices 101*a-b*. Accordingly, the remote reflector is 107 is configured to reflect light having the first, second, and third wavelengths in the target direction 117.

For example, the light emitting device 101*a* may be configured to transmit blue light, and the luminescent layer 109 may include a yellow phosphor so that white light is reflected off the reflector 107 in the target direction 117 as discussed above. In addition, the light emitting device 101*b* may be configured to transmit red light that is reflected off the reflector 107 in the target direction to provide "warmth" to the white light provided by combining the blue and yellow light. Moreover, multiple blue light emitting devices and/or multiple red light emitting devices may be provided to increase an intensity of blue and/or red light transmitted to the luminescent layer 109 and the reflector 107, and/or light emitting devices configured to transmit light of other colors (wavelengths) may be provided in addition to or instead of blue and/or red. In addition, the luminescent layer 109 may include phosphors generating light having a color(s) other than yellow and/or the luminescent layer 109 may include a plurality of different phosphors generating a plurality of different colors.

A third light emitting device (such as LED 101*c*) on the substrate 103, for example, may be configured to transmit light having the first wavelength along a path away from the substrate 103 and toward the luminescent layer 109 and the remote reflector 107. While three light emitting devices are shown in FIG. 1 by way of example, any number of light emitting devices may be used. For example, only a single light emitting device transmitting light having the first wavelength may be used. Moreover, multiple light emitting devices transmitting the first wavelength may be used to increase an intensity of light of the first and second wavelengths. In addition or in an alternative, one or more light emitting devices may be provided transmitting light having a wavelength(s) different than the first wavelength.

As shown in FIG. 1, the housing reflector 101 may be provided on the substrate 103 surrounding the light emitting devices 101*a-c*, and inner surfaces of the housing reflector 101 may be angled to direct light from the light emitting devices 101*a-c* toward the remote reflector 107. Moreover, the housing reflector 105 may be spaced apart from the remote reflector 107 and from the luminescent layer 109 as shown in FIG. 1.

An enlarged plan view (taken from a direction of the reflector 107 back toward the light emitting devices 101*a-c*) of the housing reflector 105 and light emitting devices 101*a-c* on the substrate 103 according to some embodiments of the present invention is provided in FIG. 3. As shown in FIG. 3, the housing reflector 105 may surround the light emitting devices, and additional light emitting devices 101*d-e* (not shown in the cross-section of FIG. 1) may be included. The substrate 103 may include electrical couplings between the light emitting devices 101*a-e* and a power source(s) on the substrate 103 and/or on the support structure 111. The substrate 103, for example, may include a printed circuit board.

While the path(s) 115 of light transmitted by the light emitting devices 101*a-c* are illustrated in FIG. 1 as being substantially perpendicular with respect to the substrate 103, it will be understood that each of the light emitting devices 101*a-c* may transmit light in a hemispheric or quasi-hemispheric pattern from directions substantially parallel with respect to the substrate 103 to directions substantially perpendicular with respect to the substrate 103 and directions therebetween. By providing the housing reflector 105, more light from the light emitting devices 101*a-c* may be directed to the remote reflector 107 to direct more light more efficiently in the target direction(s) 117 and to reduce potential light emission in other directions, which may be wasted and/or otherwise undesired (e.g., as light pollution). Moreover, a height of the housing reflector 105 relative to the substrate 103 may be greater than a height of the light emitting devices 101*a-c* relative to the substrate 103 to reduce loss of light and/or light pollution in a direction parallel to a surface of the substrate 103.

According to some embodiments of the present invention, the housing reflector 105 and the substrate 103 may be separately formed and then assembled, and/or the housing reflector 105 may be formed on the substrate 103. According to other embodiments of the present invention, the housing reflector 105 and the substrate 103 may be formed together as a single unit. According to still other embodiments of the present invention, the substrate 103 may be provided as a part of the support structure 111. According to yet other embodiments of the present invention, the housing reflector 105 may be omitted, and/or the light emitting devices 101*a-c* may be provided in recesses of the substrate 103.

As further shown in FIG. 1, a support structure 111 may be used to maintain a desired orientation of the substrate 103 and light emitting devices 101*a-c* thereon relative to the remote reflector 107. Moreover, the support structure 111 may be configured to maintain the remote reflector 107 and the light emitting devices 101*a-c* in an orientation to direct light reflected from the remote reflector 107 in a target direction(s) 117. A coupling 201*a* between the remote reflector 107 and the support structure 111 and/or a coupling 201*b* between the substrate 103 and the support structure 111 may be adjustable to provide different target direction(s) 117 and/or to provide a wider or narrower focus of light transmitted in the target direction(s) 117. The support structure 111, for example, may include a pole of a street light to elevate the remote reflector 107 10 feet or more off the ground, a base of a lamp to elevate the remote reflector 107 one to three feet off a table or desk, a base of a pole lamp to elevate the remote reflector 107 4 to 7 feet off a floor. According to other embodiments of the present invention, the structure of FIG. 1 may be configured to provide track lighting so that the support structure 111 is mounted to a ceiling or a wall with the target direction 117 directed down (for direct lighting), up (for indirect lighting), or any direction therebetween. As shown in FIG. 1, support structure 111 may include a primary support member 111*a*, a first elongate member 111*b* extending away from the primary support member 111*a*, and a second elongate member 111*c* extending away from the primary support member 111*a*, with the first and second elongate members being spaced apart.

Figure 2:
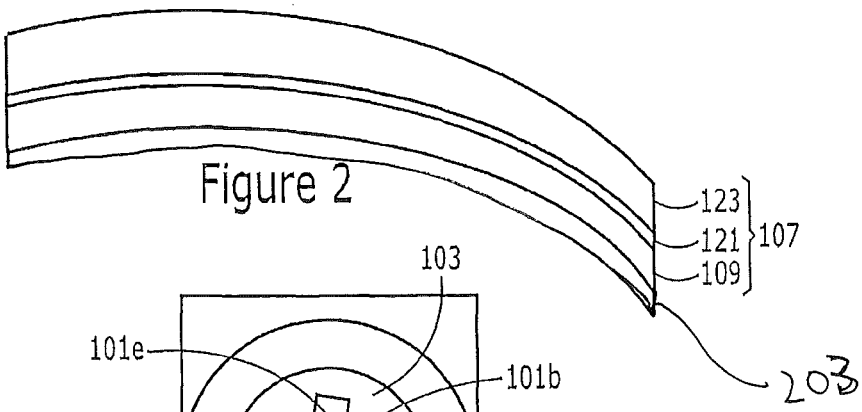
FIG. 2 is an enlarged cross-sectional view of a reflector with a luminescent layer thereon according to embodiments of the present invention.

As shown in FIG. 2, the remote reflector 107 may include a reflective surface 121 on an opaque support member 123, and the luminescent layer 109 may be provided on the reflective surface 121. More particularly, the reflective surface 121 may include a metallic layer, such as a layer of silver and/or aluminum. The luminescent layer 109 may include a phosphor material in a translucent and/or transparent binder agent. More particularly, the binder agent may include a silicone, an epoxy, and/or a plastic, and the phosphor material may include a yttrium-aluminum-garnet (YAG) phosphor material, an oxynitride phosphor material, a nitride phosphor material, and/or a zinc oxide phosphor material. According to some embodiments of the present invention, the luminescent layer 109 may include YAG and red phosphors. The support member 123 may be "optically black" so that any light transmitted through the reflective surface 121 may be blocked from transmission through the support member 107.

As shown in FIGS. 1 and 2, the remote reflector 107 may have a concave reflector surface configured to focus the reflected light having the first and second wavelengths. With a concave shape, portions of the concave reflector surface may be symmetric about a point (for example, providing a spheroidal, paraboloidal, and/or hyperboloidal shape) and/or portions of the concave reflector surface may be symmetric about a line (for example, providing a cylindrical shape). While concave reflectors are discussed by way of example, the remote reflector 107 may have other reflector surface shapes (such as flat and/or convex) according to other embodiments of the present invention.

Figure 4A:
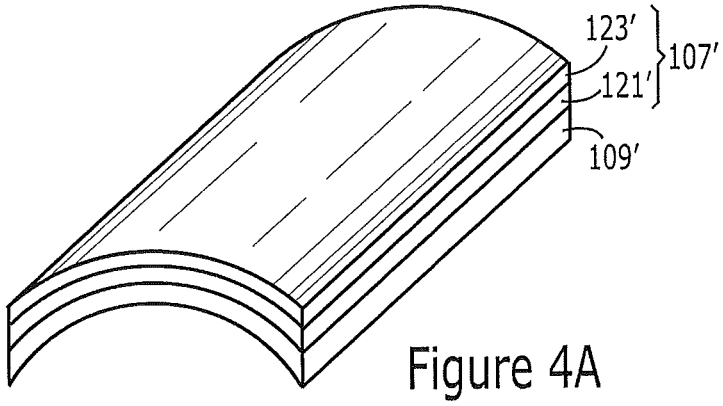
FIGS. 4A and 4B are perspective views illustrating remote reflectors having concave shapes according to embodiments of the present invention.
Figure 4B:
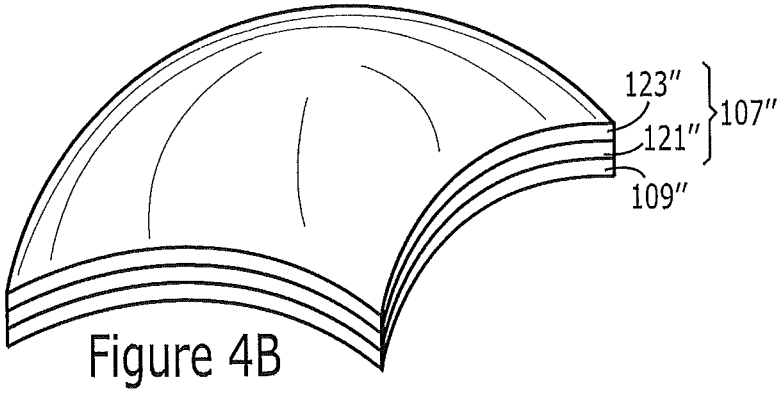

Examples of remote reflector shapes are illustrated in FIGS. 4A and 4B. FIG. 4A illustrates a remote reflector 107' (including support member 123' and reflective surface 121') with a luminescent layer 109' thereon, wherein the remote reflector 107' has a shape that is symmetric about a line (such as a cylindrical shape). FIG. 4B illustrates a remote reflector 107" (including support member 123" and reflective surface 121") with a luminescent layer 109" thereon, wherein the remote reflector 107" has a shape that is symmetric about a point (such as a spheriodal shape.) The support members, reflective surfaces, and luminescent layers of FIGS. 4A and 4B may be provided as discussed above with respect to FIGS. 1 and 2. Moreover, the reflector 107 of FIG. 1 may be provided having shapes as illustrated for example in FIG. 4A or FIG. 4B, or the reflector 107 of FIG. 1 may be provided having other shapes.

While not shown in FIG. 1, the light emitting devices 101*a-c*, the housing reflector 105, the remote reflector 107, and/or the luminescent layer 109 and/or portions thereof may be shielded and/or protected from an external environment. For example, an encapsulant such as a transparent epoxy, plastic, and/or silicone layer may be provided on the light emitting devices 101*a-c* and/or on the housing reflector 105. In addition or in an alternative, the light emitting devices 101*a-c*, the housing reflector 105, the luminescent layer, and the remote mirror 107 may be enclosed with a transparent window allowing transmission of the output light in the target direction 117.

According to embodiments of the present invention, structures illustrated in FIGS. 1 and 2 may be scaled in size to provide lighting systems for different applications. For example, the light emitting device(s) 101*a-c* may be spaced apart from the reflector surface 107 and from the luminescent layer 109 by a distance (e.g., in a direction along light path(s) 115) in the range of about 1 cm to about 10 cm or greater in a desk lamp. In an alternative, the light emitting device(s) 101*a-c* may be spaced apart from the reflector surface 107 and from the luminescent layer 109 by a distance in the range of about 10 cm to about 300 cm or greater in a street light. With a greater separation between the light emitting device(s) 101*a-c* and the remote reflector 107, a reflective surface area of the remote reflector may increase. In a street light application, for example, the light emitting device may be spaced apart from the reflector surface and from the luminescent layer by a distance of at least about 1 meter, and more particularly, by a distance in the range of about 2 meters to about 3 meters. A spacing of the light emitting device from the reflector surface and/or from the luminescent layer may be a function of, for example, a size of the reflector surface, a curvature of the reflector surface, an area being illuminated, and/or a distance from the reflector to the area being illuminated.

The remote reflector 107 may include one or more additional layers 203 such as a diffusion layer, a scattering layer, and/or a clear protective layer. A diffusion and/or a scattering layer may be provided between the luminescent layer 109 and the reflective surface 121, and/or on the luminescent layer 109 opposite the reflective surface 121. A protective layer may be provided on the luminescent layer 109 opposite the reflective surface 121.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A lighting system comprising:

a light emitting device configured to transmit visible light having a first color;

a housing reflector adjacent the light emitting device, wherein the housing reflector is configured to reflect a portion of the visible light transmitted by the light emitting device;

a remote reflector having a reflective surface spaced apart from the light emitting device and spaced apart from the housing reflector, wherein the reflective surface of the remote reflector is in a direct path of light transmitted by the light emitting device to the remote reflector and in an indirect path of light transmitted by the light emitting device and reflected by the housing reflector to the remote reflector;

a luminescent layer on the reflective surface of the remote reflector, wherein the luminescent layer is configured to convert a portion of the visible light having the first color to visible light having a second color different than the first color, wherein the reflective surface is configured to reflect visible light having the first and second colors, and wherein the reflective surface is configured to direct light in a target direction so that the visible light having the first color from the light emitting device is transmitted in the target direction only after reflection from the reflective surface; and at least one adjustable coupling that is configured to be adjustable to adjust at least one of the target direction of the light reflected by the remote reflector and a focus of the light reflected by the remote reflector, wherein the at least one adjustable coupling comprises at least one of an adjustable coupling between a support structure and the remote reflector and an adjustable coupling between the support structure and the light emitting device.

2. The lighting system of claim 1 wherein the luminescent layer comprises a phosphor material configured to convert the portion of the visible light having the first color to visible light having the second color, and wherein the light emitting device and the housing reflector are free of the phosphor material.

3. The lighting system of claim 1 wherein the light emitting device comprises one of a plurality of light emitting devices configured to transmit visible light, and wherein the reflective surface of the remote reflector is in a direct path of light transmitted by the plurality of light emitting devices.

4. The lighting system of claim 1, wherein the light emitting device comprises a phosphor coated light emitting device.

5. The lighting system of claim 1 wherein an entirety of the light emitting device and an entirety of the housing reflector are spaced apart from the reflective surface of the remote reflector and from the luminescent layer by a distance of at least 10 cm.

6. The lighting system of claim 1 wherein the light emitting device is mounted on a substrate, and wherein the adjustable coupling is between the support structure and the substrate.

7. The lighting system of claim 1 wherein the at least one adjustable coupling comprises the adjustable coupling between the support structure and the remote reflector.

8. The lighting system of claim wherein the at least one adjustable coupling comprises the adjustable coupling between the support structure and the light emitting device.

9. The lighting system of claim 8 wherein the light emitting device is mounted on a substrate, and wherein the adjustable coupling is between the support structure and the substrate.

10. A lighting system comprising:

a light emitting device configured to transmit visible light having a first color;

a housing reflector adjacent the light emitting device, wherein the housing reflector is configured to reflect a portion of the visible light transmitted by the light emitting device;

a remote reflector having a reflective surface spaced apart from the light emitting device and spaced apart from the housing reflector, wherein the reflective surface of the remote reflector is in a direct path of light transmitted by the light emitting device to the remote reflector and in an indirect path of light transmitted by the light emitting device and reflected by the housing reflector to the remote reflector;

a luminescent layer on the reflective surface of the remote reflector, wherein the luminescent layer is configured to convert a portion of the visible light having the first color to visible light having a second color different than the first color, wherein the reflective surface is configured to reflect visible light having the first and second colors, and wherein the reflective surface is configured to direct light in a target direction so that the visible light having the first color from the light emitting device is transmitted in the target direction only after reflection from the reflective surface; and an adjustable coupling between a support structure and the light emitting device wherein the adjustable coupling is configured to be adjustable to adjust at least one of the target direction of the light reflected by the remote reflector and a focus of the light reflected by the remote reflector.

11. The lighting system of claim 10, wherein the adjustable coupling is adjustable so that light reflected by the remote reflector is reflected in the target direction that is adjustable.

12. The lighting system of claim 10 wherein the adjustable coupling is adjustable so that a focus of the light reflected by the housing reflector is adjustable.

13. The lighting system of claim 10 wherein an entirety of the light emitting device and an entirety of the housing reflector are spaced apart from the reflective surface of the remote reflector and from the luminescent layer by a distance of at least 10 cm.

14. The lighting system of claim 10 wherein the light emitting device is mounted on a substrate and the wherein the adjustable coupling is between the support structure and the substrate.

15. A lighting system comprising:

a light emitting device configured to transmit visible light having a first color;

a housing reflector adjacent the light emitting device, wherein the housing reflector is configured to reflect a portion of the visible light transmitted by the light emitting device;

a remote reflector having a reflective surface spaced apart from the light emitting device and spaced apart from the housing reflector, wherein the reflective surface of the remote reflector is in a direct path of light transmitted by the light emitting device to the remote reflector and in an indirect path of light transmitted by the light emitting device and reflected by the housing reflector to the remote reflector;

a luminescent layer on the reflective surface of the remote reflector, wherein the luminescent layer is configured to convert a portion of the visible light having the first color to visible light having a second color different than the first color, wherein the reflective surface is configured to reflect visible light having the first and second colors, and wherein the reflective surface is configured to direct light in a target direction so that the visible light having the first color from the light emitting device is transmitted in the target direction only after reflection from the reflective surface; and an adjustable coupling between a support structure and the remote reflector wherein the adjustable coupling is configured to be adjustable to adjust at least one of the target direction of the light reflected by the remote reflector and a focus of the light reflected by the remote reflector.

16. The lighting system of claim 15 wherein the adjustable coupling is adjustable so that light reflected by the remote reflector is reflected in the target direction that is adjustable.

17. The lighting system of claim 15 wherein the adjustable coupling is adjustable so that a focus of the light reflected by the housing reflector is adjustable.

18. The lighting system of claim 15 wherein the luminescent layer comprises a phosphor material configured to convert the portion of the visible light having the first color to visible light having the second color, and wherein the light emitting device and the housing reflector are free of the phosphor material.

19. The lighting system of claim 15 wherein an entirety of the light emitting device and an entirety of the housing reflector are spaced apart from the reflective surface of the remote reflector and from the luminescent layer by a distance of at least 10 cm.

* * * * *

UNITED STATES PATENT AND TRADEMARK OFFICE

CERTIFICATE OF CORRECTION

PATENT NO. : 9,217,553 B2
APPLICATION NO. : 13/216434
DATED : December 22, 2015
INVENTOR(S) : Medendorp, Jr.

It is certified that error appears in the above-identified patent and that said Letters Patent is hereby corrected as shown below:

In the Claims:

Column 11, Claim 8, Line 1: Please correct "of claim wherein"
to read -- of claim 1 wherein --

Signed and Sealed this
Twenty-eighth Day of June, 2016

Michelle K. Lee

Michelle K. Lee
*Director of the United States Patent and Trademark Office*